US011445293B2

(12) United States Patent
Hosaka

(10) Patent No.: US 11,445,293 B2
(45) Date of Patent: Sep. 13, 2022

(54) EARPHONES

(71) Applicant: MOVE COMPANY LIMITED, Tokyo (JP)

(72) Inventor: Akihiko Hosaka, Tokyo (JP)

(73) Assignee: MOVE COMPANY LIMITED, Tokyo (JP)

( * ) Notice: Subject to any disclaimer, the term of this patent is extended or adjusted under 35 U.S.C. 154(b) by 0 days.

(21) Appl. No.: 17/293,912

(22) PCT Filed: Nov. 25, 2018

(86) PCT No.: PCT/JP2018/043304
§ 371 (c)(1),
(2) Date: May 14, 2021

(87) PCT Pub. No.: WO2020/105197
PCT Pub. Date: May 28, 2020

(65) Prior Publication Data
US 2022/0021968 A1 Jan. 20, 2022

(51) Int. Cl.
*H04R 1/10* (2006.01)
*H04R 1/34* (2006.01)

(52) U.S. Cl.
CPC ..... *H04R 1/345* (2013.01); *H04R 1/1016* (2013.01); *H04R 2420/07* (2013.01)

(58) Field of Classification Search
CPC .. H04R 1/1016; H04R 1/1058; H04R 1/1075; H04R 25/554; H04R 25/604; H04R 2225/77
See application file for complete search history.

(56) References Cited

U.S. PATENT DOCUMENTS 4,972,492 A * 11/1990 Tanaka ..... H04R 1/1016 381/372
5,166,659 A * 11/1992 Navarro ..... H04R 25/654 381/328
8,139,806 B2 * 3/2012 Hosaka ..... H04R 1/2842 381/373

(Continued)

FOREIGN PATENT DOCUMENTS

JP 2003032772 A * 1/2003
JP 201582824 A 4/2015

(Continued)

*Primary Examiner* — Ryan Robinson
(74) *Attorney, Agent, or Firm* — Hauptman Ham, LLP

(57) ABSTRACT

An earphone includes a sound guide tube extending in a uniaxial direction; a speaker offset to one side of a direction orthogonal to the uniaxial direction and on side of a base end of the sound guide tube; a wireless communication board on side of a back face of the speaker with respect to the sound guide tube; and a housing including a front part and rear part, the front part supporting the base end of the sound guide tube and expanding from the base end to the one side via an inclined surface inclining to the uniaxial direction, to accommodate the speaker, and the rear part expanding from the base end to other side of the orthogonal direction to accommodate the wireless communication board, and a distance between central axes of the speaker and the sound guide tube is smaller than an internal radius of the sound guide tube.

6 Claims, 1 Drawing Sheet

(56) References Cited

U.S. PATENT DOCUMENTS

| | | | | |
|---|---|---|---|---|
| 8,447,060 | B2 * | 5/2013 | Huang | H04R 1/1016 381/374 |
| 8,594,359 | B2 * | 11/2013 | Takei | H04R 1/1016 381/384 |
| 8,638,970 | B2 * | 1/2014 | Burton | H04R 1/1016 181/135 |
| 9,197,959 | B2 * | 11/2015 | Fukushima | H04R 1/1058 |
| 9,736,569 | B2 * | 8/2017 | Kelly | H04R 25/652 |
| 10,582,284 | B2 * | 3/2020 | Trainer | G10K 11/178 |
| 10,602,255 | B2 * | 3/2020 | Sandanger | H04R 1/10 |
| 11,057,695 | B2 * | 7/2021 | Williams | H04R 1/1075 |
| 11,095,968 | B2 * | 8/2021 | Birch | H04R 1/1041 |
| 11,095,973 | B1 * | 8/2021 | Zalisk | H04R 1/1016 |
| 11,240,581 | B2 * | 2/2022 | Sampei | H04R 1/1091 |
| 2008/0153556 | A1 | 6/2008 | Oh | |
| 2013/0294634 | A1 * | 11/2013 | Chen | H04R 1/1016 381/380 |
| 2018/0020281 | A1 * | 1/2018 | Wurtz | A61F 11/08 |
| 2018/0213316 | A1 * | 7/2018 | Oishi | H04R 1/1016 |
| 2022/0095034 | A1 * | 3/2022 | Liu | H04R 1/1091 |

FOREIGN PATENT DOCUMENTS

| | | | | |
|---|---|---|---|---|
| JP | 201584568 | A | 4/2015 | |
| JP | 2016195469 | A | 11/2016 | |
| JP | 6431569 | B1 | 11/2018 | |
| WO | WO-2017022240 | A1 * | 2/2017 | A61B 5/0084 |

* cited by examiner

EARPHONES

RELATED APPLICATIONS

The present application is a National Phase of International Application Number PCT/JP2018/043304, filed Nov. 25, 2018.

TECHNICAL FIELD

The present invention relates to earphones.

BACKGROUND ART

Earphones are audio equipment to be used by placing a housing into the ear (cavum conchae), the housing configured to accommodate a speaker, and inserting a sound guide tube into an external acoustic opening, the sound guide tube configured to transmit sounds emitted by the speaker (See Patent Literature 1, for example). An ear has a recess, which is referred to as the cavum conchae, between the tragus on a front side (side facing a facial surface) and the antitragus (and the antihelix) on a back side (side facing a back of the head). The external acoustic opening extends frontwards at an angle of approximately 60 degrees to an inner surface of the cavum conchae, from a position proximate to the tragus in the cavum conchae deeply thereinto. To achieve low-frequency characteristics with good sounds, a large speaker having an outside diameter of 13 mm or larger, for example, is necessary. To achieve good high-frequency characteristics, it is necessary to place the sound guide tube proximate to the speaker and to transmit to the sound guide tube sounds outputted from the speaker, without the sounds being reflected within the housing.

However, the external acoustic opening is proximate to the tragus and the tragus projects to side opposite to the drum membrane with respect to the external acoustic opening. Thus, if a configuration is such that the housing is placed in the cavum conchae without interference with the tragus and the sound guide tube is inserted into the external acoustic opening (see Patent Literature 1, for example), an axial direction of the sound guide tube has an angle to a sound-emitting direction of the speaker. This causes reflection of the sounds within the housing, degrading the high-frequency characteristics. Then, in order to dispose the speaker with the axial direction of the sound guide tube aligned with the sound-emitting direction of the speaker, if the configuration is such that speaker is small to circumvent the tragus, for example, the low-frequency characteristics degrade. In contrast, if the configuration is such that a large speaker is disposed in front of the tragus, the speaker is spaced from the sound guide tube, degrading the high-frequency characteristics.

In recent years, earphones that receive an audio signal through wireless communications such as Bluetooth® are common. Such earphones further accommodate a wireless communication board and a power supply in addition to a speaker (see Patent Literature 2, for example), which thus makes an increase in weight and size inevitable. This does not allow an earphone to fit in the cavum conchae and leads to provision of a rear case projecting from the cavum conchae to the front. The weight of the rear case including the wireless communication board and the power supply generates downward force, making it difficult to wear the earphone on the ear in a stable manner.

CITATION LIST

Patent Literature

Patent Literature 1: Japanese Unexamined Patent Application Publication No. 2016-195469

Patent Literature 2: Japanese Unexamined Patent Application Publication No. 2015-084568

SUMMARY OF THE INVENTION

Problems to be Solved by the Invention

The present invention is to provide earphones that receive an audio signal through wireless communications, allows for wearing on the ear in a stable manner, and has good sound quality.

Means for Solving the Problems

An earphone of the present invention includes:

a sound guide tube extending in a uniaxial direction;

a speaker offset to one side of a direction orthogonal to the uniaxial direction and disposed on side of a base end of the sound guide tube, the speaker outputting sounds to the uniaxial direction;

a wireless communication board disposed on side of a back face of the speaker with respect to the sound guide tube; and a housing having a front part and rear part, the front part supporting the base end of the sound guide tube and expanding from the base end to the one side via an inclined surface that inclines to the uniaxial direction, to accommodate the speaker, and the rear part expanding from the base end to other side of the orthogonal direction to accommodate the wireless communication board, wherein the earphone is characterized in that a separation distance between a central axis of the speaker and a central axis of the sound guide tube is smaller than an internal radius of the sound guide tube.

According to this characteristic, the speaker is accommodated in the expanded front part. Thus, it is possible to make the speaker large and direct the speaker to the same direction as the sound guide tube. Therefore, it is possible to provide an earphone that does not degrade high-frequency characteristics and has the good sound quality. In addition, it is possible to accommodate, in the expanded rear part, the wireless communication board (which may include a power supply) that receives the audio signal through the wireless communications. The front part being supported by the tragus and the antitragus and the rear part being supported by side of the scapha, it is possible to wear the earphone on the ear in a stable manner.

The inclined surface of the earphone of the present invention is characterized in that:

the inclined surface inclines at an angle from 25 to 35 degrees to the orthogonal direction and is formed in a recessed shape.

According to this characteristic, the inclined surface abuts an inner surface of the cavum conchae when the earphone is worn on the ear, which makes it possible to wear the earphone in a stable manner.

The front part of the earphone of the present invention is characterized in that:

the front part has a shape decentered from the base end of the sound guide tube to one side of the direction orthogonal to the uniaxial direction, when seen from the one side to the other side of the uniaxial direction, and the rear part has a shape having, as a long axis direction, the direction orthogonal to the uniaxial direction, when seen from the one side to the other side of the uniaxial direction.

According to this characteristic, the rear part is extremely proximate to the tragus and disposed thereon, thus allowing a large wireless communication board to be accommodated without being restricted in size due to the tragus. Moreover, as the rear part accommodates the wireless communication board and the power supply, the rear part has a heavy weight and is subject to downward gravity. Nevertheless, the rear part is supported by the scapha, and the earphone does not drop from the ear even under the gravity. Therefore, wearing of an earphone 1 on the ear in a stable manner is allowed.

The rear part of the earphone of the present invention is characterized in that:

the rear part accommodates the power supply between the speaker and the wireless communication board, the power supply supplying electric power to the speaker and the wireless communication board.

According to this characteristic, the rear part accommodating the power supply between the speaker and the wireless communication board makes it possible to provide a large power supply in a space therebetween and use the speaker for a long period of time.

The rear part of the earphone of the present invention is characterized in that:

the rear part includes an operation screen on side of a back face with respect to the sound guide tube.

According to this characteristic, it is possible to provide a large operation screen on the back face of the rear part.

An earphone according to the present invention includes:

a sound guide tube extending in a uniaxial direction;

a speaker offset to one side of a direction orthogonal to the uniaxial direction and disposed on side of a base end of the sound guide tube, the speaker outputting sounds to the uniaxial direction;

a wireless communication board disposed on side of a back face of the speaker with respect to the sound guide tube; and a housing having a front part and a rear part, the front part supporting the base end of the sound guide tube and expanding from the base end to the one side via an inclined surface that inclines to the uniaxial direction, to accommodate the speaker, and the rear part expanding from the base end to other side of the orthogonal direction to accommodate the wireless communication board, wherein the earphone is characterized in that:

the rear part includes an operation screen on a back face with respect to the sound guide tube.

According to this characteristic, it is possible to provide a large operation screen on the back face of the rear part.

Effect of the Invention

According to the present invention, it is possible to provide an earphone that receives an audio signal through wireless communications, allows for wearing on the ear in a stable manner, and has good sound quality.

MODES FOR CARRYING OUT THE INVENTION

In the following, description is given of an example of the present invention.

Figure 1A:
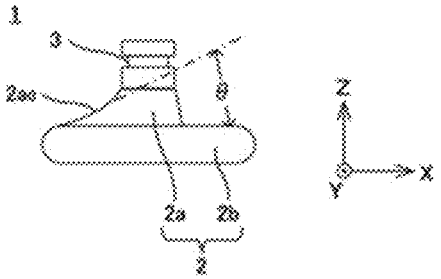
FIG. 1A, FIG. 1B and FIG. 1C are diagrams illustrating a configuration of an earphone.
Figure 1B:
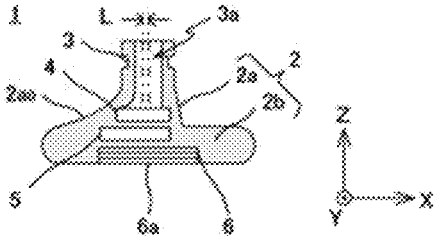
Figure 1C:
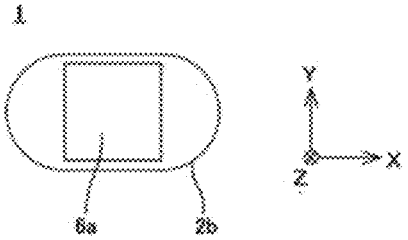

FIG. 1A, FIG. 1B and FIG. 1C are diagrams illustrating a configuration of an earphone. FIG. 1A is a top view illustrating the configuration of an earphone 1 when seen from the top view. FIG. 1B is a cross-sectional diagram illustrating an internal configuration of the earphone 1. FIG. 1C is a front view illustrating the configuration of the earphone 1 when seen from the front view. An axial direction of a sound guide tube 3 is a Z-axis direction, and directions, which are perpendicular thereto and are mutually orthogonal, are an X-axis direction and a Y-axis direction.

The earphone 1 is an earphone for the right ear and includes the sound guide tube 3, a housing 2, a speaker 4, a power supply 5, and a wireless communication board 6. It is to be noted that an earphone for the left ear has a shape symmetrical to the earphone 1 in the X-axis direction.

The sound guide tube 3 is a tubular member that transmits sounds outputted from the speaker 4. The sound guide tube 3 is molded into a cylindrical shape by means of a thermoplastic resin, for example. An internal radius of a hollow part is equal to or larger than 3 mm, for example. It is to be noted that an earpiece molded from silicon rubber or the like may be provided at a tip of the sound guide tube 3. With this, when the sound guide tube 3 is inserted into the external acoustic opening, the earpiece deforms and fits into the opening, thus making it possible to support the sound guide tube 3 while keeping the interior of the external acoustic opening airtight.

The housing 2 is a casing that accommodates the speaker 4, the power supply 5, and the wireless communication board 6. The housing 2 includes a front part 2*a* and a rear part 2*b*. It is possible to mold the front part 2*a* and the rear part 2*b*, including the sound guide tube 3, integrally from a same material as that of the sound guide tube 3.

The front part 2*a* is a section that supports a base end of the sound guide tube 3 and accommodates the speaker 4. On an outer surface, the front part 2*a* has an inclined surface 2*a*0 that inclines to the Z-axis direction (or the X-axis direction orthogonal thereto). The front part 2*a* is molded into a decentered frustum shape in which via the inclined surface 2*a*0, the front part 2*a* expands from the base end of the sound guide tube 3 to −X side, but slightly expands to +X side. This makes it possible to accommodate the speaker 4 in the front part 2*a* in the proximity of the sound guide tube 3 and to fit the front part 2*a* in the cavum conchae without interference with the tragus. In addition, the inclined surface 2*a*0 inclines at an angle of, for example, 25 to 35 degrees, preferably at an angle θ which is approximately 30 degrees to the X-axis. With this, when the earphone 1 is worn on the ear, the inclined surface 2*a*0 abuts the inner surface of the cavum conchae and it is possible to direct the sound guide tube 3 toward the external acoustic opening and insert the sound guide tube 3 thereinto.

The rear part 2*b* is a section that accommodates the power supply 5 and the wireless communication board 6 on −Z side of the front part 2*a*. The rear part 2*b* has an oval shape (or a rounded corner oval shape) with the X-axis direction as longitudinal when seen from the front view. The sound guide tube 3 being disposed at approximately the center of the oval shape, the rear part 2*b* projects (expands) from the base end of the sound guide tube 3 to the +X side. The rear part 2*b* exposes an operation screen 6*a* such as a touch panel or the like to side of a back face with respect to the sound guide tube 3, more specifically, to a Z-face, and supports the operation screen 6*a*. This makes it possible to provide the large operation screen 6*a* in the housing 2.

The speaker 4 is a device that outputs sounds. A large speaker having an outside diameter of 13 mm or larger is adopted so as to output sounds with good low-frequency characteristics. Expansion of the front part 2*a* from the base end of the sound guide tube 3 to the −X side allows the speaker 4 to be large. The speaker 4 emits sounds along a central axis parallel to the Z-axis that passes through the center of the speaker 4 (more specifically, a diaphragm) by causing the diaphragm facing a uniaxial direction (here, the Z-axis direction) to vibrate according to an electric signal inputted externally, by means of a voice coil, a piezoelectric element, or the like (See FIG. 1B). It is to be noted that molding the center of the diaphragm in a dome shape with the outside diameter of 8 mm, for example, allows for output of good sounds also for medium- and high-frequency characteristics.

On the side of the base end of the sound guide tube 3, the speaker 4 is offset to the −X side with the respect to the sound guide tube 3 toward the Z-axis direction and is accommodated in the front part 2*a*. Here, suppose that a separation distance L between the center of the speaker 4 and the central axis of the sound guide tube 3 is smaller than the internal radius of the sound guide tube 3 (more specifically, less than 3 mm). This makes it possible to conduct sounds outputted from the speaker 4 to the Z-axis direction through the sound guide tube 3, without the sounds being reflected or with less reflection in the hollow part of the front part 2*a*, more specifically, without degrading the high-frequency characteristics. Consequently, achievement of the good sound quality is possible.

The power supply 5 is a power supply that supplies electric power to the speaker 4 and the wireless communication board 6. In the housing 2, the power supply 5 is disposed between the speaker 4 and the wireless communication board 6 and accommodated within the rear part 2*b*. It is to be noted that the power supply 5 may be accommodated in the front part 2*a* or accommodated across both of the front part 2*a* and the rear part 2*b*. This allows for provision of a large power supply in the space between the speaker 4 and the wireless communication board 6 and use of the speaker 4 for a long period of time.

The wireless communication board 6 is a board where a control circuit is provided that receives an audio signal from an external apparatus (not illustrated) through wireless communications such as Bluetooth®, for example, and drives the speaker 4. The wireless communication board 6 is disposed on the side of the back face of the speaker 4 and the power supply 5 with respect to the sound guide tube 3, and is accommodated in the rear part 2*b*. The wireless communication board 6 supplies power to the operation screen 6*a* by means of noncontact power supply, and controls the speaker 4 through an operation inputted by a user via the operation screen 6*a*.

Figure 2A:
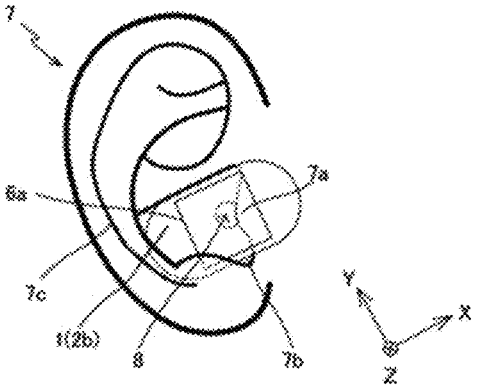
FIG. 2A and FIG. 2B are diagrams illustrating a state in which the earphone is worn on the ear.
Figure 2B:
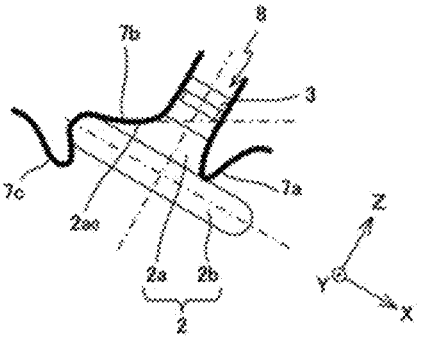

FIG. 2A and FIG. 2B illustrate a state in which the earphone 1 is worn on the ear 7. FIG. 2A is a diagram of the state of wearing when seen from outside of the ear. FIG. 2B is a diagram illustrating a cross section including the external acoustic opening. The front part 2*a* is inserted into the cavum conchae 7*b* with a −X end of the front part 2*a* directed to side of the scapha 7*c* and a +X end of the rear part 2*b* directed to side of the tragus 7*a*. The sound guide tube 3 is inserted into the external acoustic opening 8 with the inclined surface 2*a*0 abutting the inner surface of the cavum conchae 7*b*.

From the base end of the sound guide tube 3, the +X end of the front part 2*a* is supported by the back side of the tragus 7*a* and the −X end of the front part 2*a* is supported by the cavum conchae 7*b*.

The rear part 2*b* is extremely proximate to the tragus 7*a* and disposed thereon. Therefore, it is possible for the rear part 2*b* to project (expand) to the +X side without being restricted in size due to the tragus 7*a* and to accommodate the large wireless communication board 6.

The rear part 2*b* that accommodates the wireless communication board 6 and the power supply 5 has a heavy weight and is subjected to gravity which acts in a downward direction in FIG. 2A. However, the −X end of the rear part 2*b* is supported by the scapha 7*c*, and even under the gravity, no moment is generated that causes the earphone 1 to drop from the ear 7.

Consequently, the earphone 1 is worn on the ear 7 in a stable manner.

As described above in detail, the earphone 1 of the example includes the sound guide tube 3 extending in the Z-axis direction; the speaker 4 offset to the −X side and disposed on the side of the base end of the sound guide tube 3, the speaker 4 outputting sounds to the Z-axis direction; the wireless communication board 6 disposed on the side of the back face of the speaker 4 with respect to the sound guide tube 3; and the housing 2 having the front part 2*a* and the rear part 2*b*, the front part 2*a* supporting the base end of the sound guide tube 3 and expanding from the base end to the −X side via the inclined surface 2*a*0 that inclines to the Z-axis direction or the X-axis direction, to accommodate the speaker 4, and the rear part 2*b* expanding from the base end to the +X side to accommodate the wireless communication board 6. The front part 2*a* is inserted into the cavum conchae 7*b* with the −X end of the front part 2*a* directed to the side of the scapha 7*c* and the +X end of the rear part 2*b* directed to the side of the tragus 7*a*, and the sound guide tube 3 is inserted into the external acoustic opening 8 with the inclined surface 2*a*0 supported by the inner surface of the cavum conchae 7*b*. With this, the +X end of the front part 2*a* is supported by the back side of the tragus 7*a* from the base end of the sound guide tube 3, and the −X end of the front part 2*a* is inserted into the back side of the scapha 7*c* and supported by the scapha 7*c*, which thus makes it possible to wear the earphone 1 on the ear in a stable manner.

INDUSTRIAL APPLICABILITY

An earphone that receives an audio signal through wireless communications, allows for wearing on the ear in a stable manner, and has good sound quality. Use by many earphone producers is expected.

DESCRIPTION OF REFERENCE NUMERALS

1 Earphone
2 Housing
2*a* Front part
2*a*0 Inclined surface
2*b* Rear part
3 Sound guide tube
4 Speaker
5 Power supply
6 Wireless communication board
6*a* Operation screen

7 Ear
7*a* Tragus
7*b* Cavum conchae
7*c* Scapha
8 External acoustic opening

The invention claimed is:

1. An earphone comprising:

a sound guide tube extending in a uniaxial direction;

a speaker offset to one side of a direction orthogonal to the uniaxial direction and disposed on side of a base end of the sound guide tube, the speaker outputting sounds to the uniaxial direction;

a wireless communication board disposed on side of a back face of the speaker with respect to the sound guide tube; and a housing including a front part and rear part, the front part supporting the base end of the sound guide tube and expanding from the base end to the one side via an inclined surface that inclines to the uniaxial direction, to accommodate the speaker, and the rear part expanding from the base end to other side of the orthogonal direction to accommodate the wireless communication board, wherein a separation distance between a central axis of the speaker and a central axis of the sound guide tube is smaller than an internal radius of the sound guide tube.

2. The earphone according to claim 1, wherein the inclined surface inclines at an angle of 25 to 35 degrees to the orthogonal direction and is formed in a recessed shape.

3. The earphone according to claim 1, wherein the front part has a shape decentered from the base end of the sound guide tube to one side of the direction orthogonal to the uniaxial direction when seen from the one side to the other side of the uniaxial direction, and the rear part has a shape having, as a long axis direction, the direction orthogonal to the uniaxial direction, when seen from the one side to the other side of the uniaxial direction.

4. The earphone according to claim 1, wherein the rear part accommodates a power supply between the speaker and the wireless communication board, the power supply supplying electric power to the speaker and the wireless communication board.

5. The earphone according to claim 1, wherein the rear part includes an operation screen on side of a back face with respect to the sound guide tube.

6. An earphone, comprising:

a sound guide tube extending in a uniaxial direction;

a speaker offset to one side of a direction orthogonal to the uniaxial direction and disposed on side of a base end of the sound guide tube, the speaker outputting sounds to the uniaxial direction;

a wireless communication board disposed on side of a back face of the speaker with respect to the sound guide tube; and a housing including a front part and a rear part, the front part supporting the base end of the sound guide tube and expanding from the base end to the one side via an inclined surface that inclines to the uniaxial direction, to accommodate the speaker, and the rear part expanding from the base end to other side of the orthogonal direction to accommodate the wireless communication board, wherein the rear part includes an operation screen on a back face with respect to the sound guide tube.

* * * * *